US007886647B2

(12) United States Patent
Holloway

(10) Patent No.: US 7,886,647 B2
(45) Date of Patent: Feb. 15, 2011

(54) SYNCHRONOUSLY TIMED FUSE PROCEDURE OR PROCESS

(76) Inventor: Craig L Holloway, 115 Fifth St., Glenwood Springs, CO (US) 81601

( * ) Notice: Subject to any disclaimer, the term of this patent is extended or adjusted under 35 U.S.C. 154(b) by 299 days.

(21) Appl. No.: 11/414,194

(22) Filed: May 1, 2006

(65) Prior Publication Data

US 2007/0039455 A1 Feb. 22, 2007

Related U.S. Application Data

(62) Division of application No. 10/643,373, filed on Aug. 20, 2003, now Pat. No. 7,299,734.

(51) Int. Cl.
*B64D 1/04* (2006.01)

(52) U.S. Cl. ..... 89/1.11; 102/302; 102/310; 102/311

(58) Field of Classification Search ..... 102/302, 102/310, 311; 86/50; 89/1.11
See application file for complete search history.

(56) References Cited

U.S. PATENT DOCUMENTS 3,830,156 A * 8/1974 Sewell et al. ..... 102/302
4,959,559 A * 9/1990 Ziolkowski ..... 359/896

* cited by examiner

*Primary Examiner*—J. Woodrow Eldred

(57) ABSTRACT

A synchronously timed fused is installed into ordnance the ordnance is delivered to a target area, in a shaped charge formation and a simultaneous explosion event occurs.

1 Claim, 5 Drawing Sheets

Figure # 1
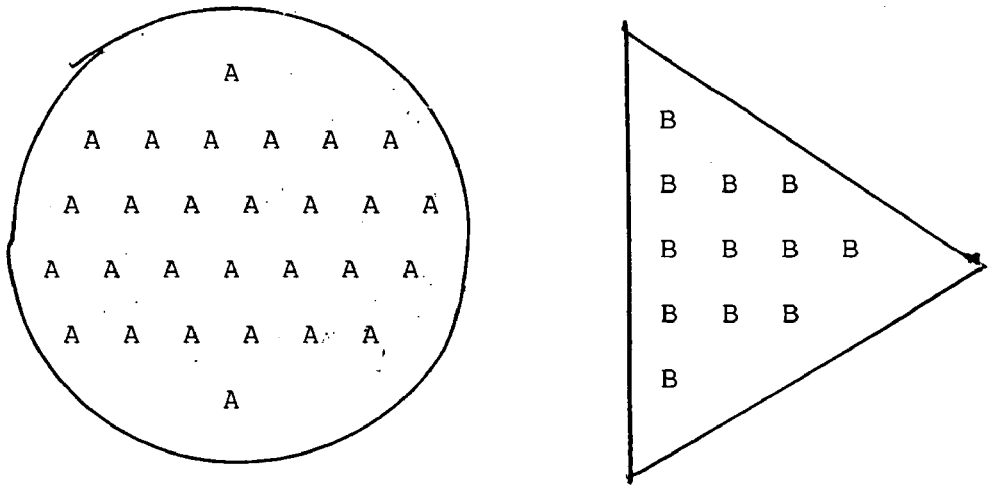

Figure # 2
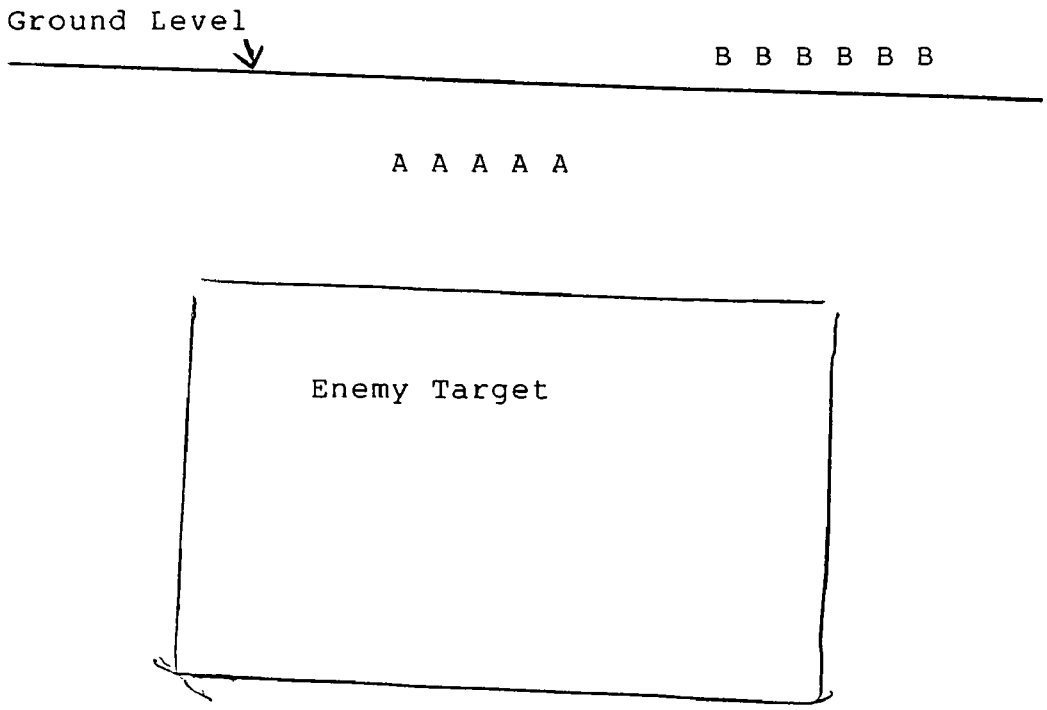

Figure # 3
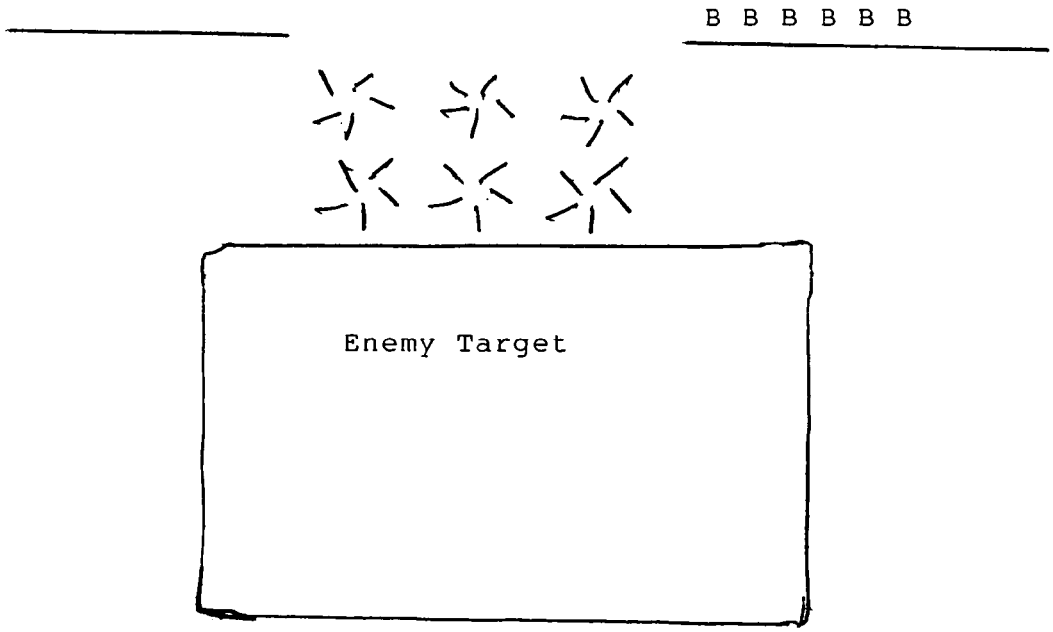

Figure # 4
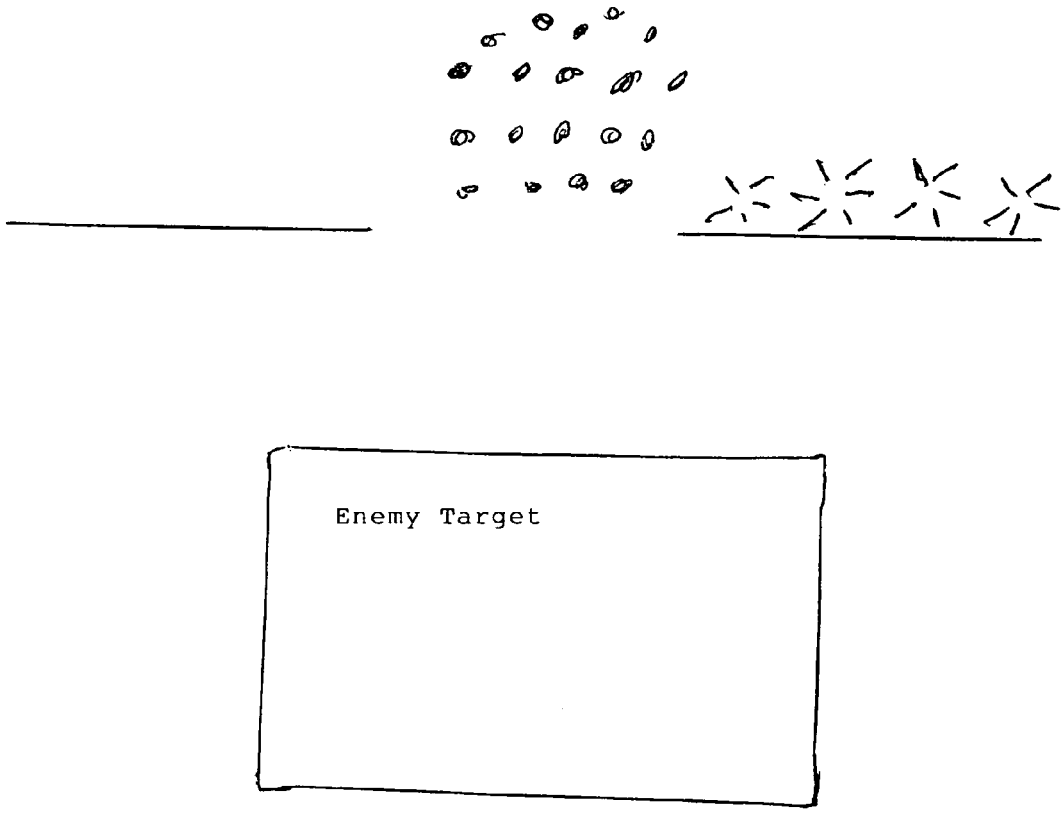

Figure # 5
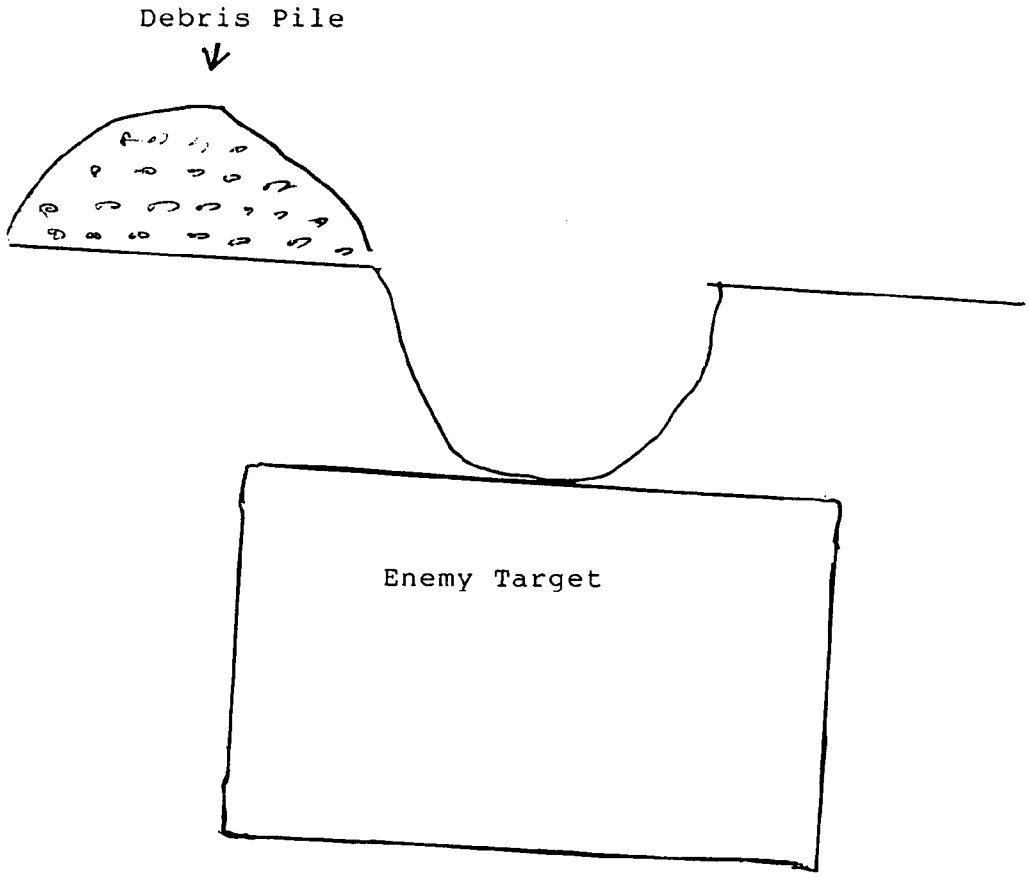

SYNCHRONOUSLY TIMED FUSE PROCEDURE OR PROCESS

This application is a divisional of Ser. No. 10/643,373 filed Aug. 20, 2003 now U.S. Pat. No. 7,299,734

BACKGROUND OF THE INVENTION

1. Field of the Invention

This invention relates in general to militarily attacking a target and in particular to enhancing an attack's effects by synchronous detonation of ordnance and enhancing an attack's effects by the geometric shapes said ordnance is applied.

2. Prior Art

Success in attacking enemy troops and installations can be the difference between life and death for our troops and our nation. Even with today's capabilities improvement is desired and necessary. With troops well dug in they can many times withstand hours or days of bombardment and still survive to fight. Deeply buried or hardened targets can, many times, survive our best efforts. It has long been known that the effects of a simultaneous salvo of artillery, as opposed to one at a time, or, a whole formation of aircraft, simultaneously dropping their bombs, as opposed to each aircraft dropping one at a time, has a different effect. Timed fuses have long been used—mainly to penetrate deeper into a material before exploding, or to harass aid and repair functions after the main bombing. They have not been well used to create a synchronous event. Shaped charges have been used since at least WWII—e.g. the bazooka round to concentrate forces to penetrate armor, or the claymore mine, to enhance directional effects. It has not been applied to how an artillery, aircraft or depth charge attack is laid out.

SUMMARY OF THE INVENTION

The object of the present invention is to provide a process to increase the desired effects on an enemy target. It is also an object to decrease the damaging effects on friendly forces or non targets.

The foregoing objects can be accomplished by fitting bombs with a time delay fuse. Each of these fuses would be set for a synchronous time. For example, one B52 flies 25 missions or 25 B52s fly one mission and deliver one kiloton of ordnance to a target area—each bomb set on a preset fuse each fuse set to a preset synchronous time. Depending on the time tolerances of the fuses an enhanced to an exponentiated effect can be expected. The foregoing can also be accomplished by the shape said ordnance is laid out. In the above example the B52s can lay their bombs in a chevron or triangle pattern for a more directed blast. As another example, Synchronously Timed Fuse Procedure (abbreviated STFP) is fired into the protective layers over a hostile bunker, this time being arranged in a cone pattern broadside of the cone facing the target, utilizing shaped charge technology, but again, on an exponentially larger scale than has been done before. Furthermore, STFP ordnance can be mixed, including but not limited to, explosives with different expansion rates, incendiary, electro magnetic, chemical and nuclear ordnance.

BRIEF DESCRIPTION OF DRAWINGS

FIG. 1 is a top view of a field of STFP ordnance laid out in a triangular pattern. Each "A" in the triangle represents a bomb to go off at a simultaneous detonation time.

FIG. 2 is a top view of STFP bombs with "H" represents a high explosive bomb and "T" represents a thermite bomb.

This was represented as FIG. 17 in original application.

FIG. 3 is a top view of STFP ordnance deployed to create a defilade, each X representing STFP bombs and each A representing STFP bombs that go off synchronously with the "X" bombs although not necessarily with the same power of or expansion rate of, the "X" bombs. Further, the "A" bombs can be wrapped with a fire retardent or an inert gas for protection from fire or Redox reaction. This was FIG. 18 in original application.

FIG. 4 Each "X" represents an STFP bomb—the placing of which creates a cutting effect.

FIG. 5 Each "X" represents an STFP bomb—the placing of which creates a spinning effect.

DETAILED DESCRIPTION

This is a process where 2 or more bombs are delivered to an area and simultaneously detonated. Delivery can be accomplished through many means now available—artillery, aircraft etc.

Detonation can be accomplished through several methods now available;

1. A timed fuse for each ordnance, each preset for a designated synchronous time. The presenting can be done minutes, hours days or years in advance.
2. A radio or electromagnetic fuse for each ordnance. The synchronous explosion event occurring when the correct frequency is broadcast.
3. Pressure or percussion fuses for each ordnance these configured in series with a timed enabler. These then detonated by 1, 2 and 3, above, or by standard artillery shell, bomb depth charge or other ordnance.
4. A combination of 1, 2 and 3 above, run in parallel for a more certain detonation event.

Placing the ordnance into the geometric shapes desired can be accomplished through well known extant technologies such as the trigonometry formulas an artillery officer uses to calculate his trajectory, the mathematical formulas a bombardier uses to drop unguided bombs, laser guided munitions technology, Global Positioning system guidance technology, ballistic missile technology, guide and unguided torpedo technology, manual placement and other extant technologies. Where depth is a consideration, presently available ordnance with various penetration capabilities can be applied.

What is claimed is:

1. A process of creating an enhanced explosion event, using a plurality of ordnance to remove an overburden protecting a buried target comprising:

(a) bombs (B) a method of delivering said bombs into a protective over burden above a buried target—these said bombs herein after referred to as "bomb subset A"

(C) a method of delivering said bombs above and to a side of said overburden-these bombs hereinafter referred to as "bomb subset B"

(D) Preset synchronously timed fuses for each bomb of bomb subset A.

(E) Preset synchronously timed fuses for each bomb of above said bomb subset B each set to go off slightly after subset A bombgroup.

* * * * *